United States Patent [19]

Sakuma et al.

[11] Patent Number: 4,521,504

[45] Date of Patent: Jun. 4, 1985

[54] COMPOSITE PHOTOSENSITIVE MATERIAL FOR USE IN ELECTROPHOTOGRAPHY

[75] Inventors: Seiitj Sakuma, Tokyo; Shuichi Karasawa, Kokubunji, both of Japan

[73] Assignee: Ricoh Company, Ltd., Tokyo, Japan

[21] Appl. No.: 274,620

[22] Filed: Jun. 17, 1981

Related U.S. Application Data

[62] Division of Ser. No. 76,095, Sep. 17, 1979, abandoned.

[30] Foreign Application Priority Data

| | | | |
|---|---|---|---|
| Sep. 22, 1978 | [JP] | Japan | 53-117273 |
| Dec. 28, 1978 | [JP] | Japan | 53-163059 |
| Dec. 28, 1978 | [JP] | Japan | 53-163060 |
| Dec. 28, 1978 | [JP] | Japan | 53-163062 |

[51] Int. Cl.[3] ..... G03G 5/12

[52] U.S. Cl. ..... 430/57; 430/46

[58] Field of Search ..... 430/57, 42, 46

[56] References Cited

U.S. PATENT DOCUMENTS

| | | | |
|---|---|---|---|
| 2,962,376 | 11/1960 | Schattert | 430/57 |
| 2,987,395 | 6/1961 | Iarvis | 430/57 |
| 3,172,828 | 3/1965 | Shepard et al. | 430/57 |
| 3,775,109 | 11/1973 | Ohta et al. | 430/57 |
| 3,992,204 | 11/1976 | Taylor | 430/57 |
| 4,111,693 | 9/1978 | Wright et al. | 430/57 |
| 4,250,239 | 2/1981 | Sakai | 430/57 |
| 4,310,610 | 1/1982 | Sakai | 430/57 |

FOREIGN PATENT DOCUMENTS

| | | | |
|---|---|---|---|
| 999405 | 7/1965 | United Kingdom | 430/57 |

*Primary Examiner*—John Kittle
*Assistant Examiner*—John L. Goodrow
*Attorney, Agent, or Firm*—Flynn, Thiel, Boutell & Tanis

[57] ABSTRACT

A composite photosensitive material for use in electrophotography which comprises a conductive substrate on which there is laminated a first photoconductive layer having a sensitivity to at least a part (Light A) of the chromatic light of visible light region and a second photoconductive layer capable of transmitting said Light A as well as having a sensitivity to another chromatic light (Light B), characterized in that said photoconductive layers are each capable of holding the electric charge of a polarity opposite to each other and additionally accepting as well as retaining a surface potential enough to develop an electrostatic latent image, which is formed by said electric charge, with a toner.

1 Claim, 16 Drawing Figures

COMPOSITE PHOTOSENSITIVE MATERIAL FOR USE IN ELECTROPHOTOGRAPHY

This is a division of application Ser. No. 76,095, filed Sept. 17, 1979 now abandoned.

BACKGROUND OF THE INVENTION (a) Field of the Invention

The present invention relates to a photosensitive material for use in electrophotography, in particular a laminate-type electrophotographic photosensitive material capable of obtaining a dichromatic (two colors, such as black and red) reproduction from a multi-color original through only one exposure process, as well as the usual monochromatic reproduction.

(b) Description of the Prior Art

As typical photosensitive materials for use in conventional Carlson process (photosensitive materials for use in electrophotography) there are well known photosensitive materials comprising a selenium photoconductive layer on a conductive substrate, a charge transfer layer made of polyvinyl carbazole or the like on said selenium photoconductive layer, and so forth.

These photosensitive materials are devised so that the surface potential thereof may hold a single positive or negative polarity in compliance with an electrostatic latent image to be formed through electrification-exposure processes. In order to obtain dichromatic reproductions using such photosensitive materials, therefore, it is ordinarily required to repeat the cycle of electrification-exposure-development-transfer. However, by the mere repetition of this cycle there can not be obtained a distinct dichromatic image owing to the occurrence of mixed colors, fog, shear in position, etc.

Reflecting this actual condition, there has been proposed a process of obtaining a dichromatic copy (Japanese Open Patent Application No. 144737/1978) which comprises the steps of carrying out a first corona electrification of a photosensitive material prepared by forming an insulating layer and a photoconductive layer, in that order, on a conductive substrate, performing the overall radiation of the thus electrified material with a light belonging to the sensitive region of said photoconductive layer either simultaneously with or after the first corona electrification, carrying out a second corona electrification of this material with a polarity opposite to that in the first electrification simultaneously with the imagewise exposure of the original having white, black and red areas (namely, the dichromatic original with red and black image areas) through a red complementary color filter, and performing the imagewise exposure again through a red filter, whereby there is created in the material wherein a condition the charged polarity of the electrostatic latent images formed on the red and black areas corresponding to the original has become opposite. Thereafter, these latent images are successively developed with toners of opposite polarity and different colors, and the resulting toner images are transferred onto image-receiving papers such as paper and are fixed thereon. However, this process is still defective in that considerably large quantities of exposure light are required in addition to the trouble of utilizing different filters two times.

SUMMARY OF THE INVENTION

One object of the present invention is to provide a novel composite photosensitive material for use in electrophotography which is widely different in photo-electric property as compared with conventional photoconductive materials which may be utilized in the Carlson process.

Another object of the present invention is to provide a photosensitive material which can always obtain a distinct, dichromatic image.

More specifically, the present invention relates to composite photosensitive materials for use in electrophotography which comprise a conductive substrate on which there is laminated a first photoconductive layer having a sensitivity to at least a part (Light A) of the chromatic light of the visible light region and a second photoconductive layer capable of transmitting said Light A as well as having a sensitivity to another chromatic light (Light B), characterized in that said photoconductive layers are each capable of holding an electric charge of a polarity opposite to the polarity of the other and additionally are capable of accepting as well as retaining a surface potential sufficient to develop an electrostatic latent image, which is formed by said electric charge, with a toner.

The photosensitive material according to the present invention is conspicuously characterized in the following two points:

(1) Each image portion of a multi-color original can be reproduced to a mutually fully discriminative extent with a monochromatic toner in accordance with the conventional Carlson process, and (2) A dichromatic image can be formed from a dichromatic original in accordance with a dichromatic electrophotographic process as described hereinafter.

The aforesaid feature (1) can be attained only by the above-mentioned performances of the first and second photoconductive layers of the photosensitive material according to the present invention, specifically, the specific wavelength absorbing ability and the chargeability. In the photosensitive material of the present invention, since the upper layer, i.e., the second photoconductive layer absorbs Light B in this case, even if the light comprising Light A and Light B (namely, Light A+B) is radiated onto the surface of the photosensitive material, Light B does not reach the lower layer, i.e., the first photoconductive layer, and even if it reaches the lower layer, the quantity of light is very little. Due to this, the first photoconductive layer should not be restricted to one having a sensitivity to Light A alone but may be one having a sensitivity to both Light A and Light B.

On the other hand, the aforesaid feature (2) can be attained by imparting a both-chargeability to at least one of the first and second photoconductive layers or imparting a commutating ability to the first photoconductive layer with relation to the conductive substrate in addition to the aforesaid basic performances.

The term "both-chargeability" referred to herein means a property in which the layer can be electrified both positively and negatively and further does permit light-decay. The term "commutating ability" used herein means a property in which the layer can be electrified only either positively or negatively and further does permit the occurrence of light-decay in the electrifying polarity.

DETAILED DESCRIPTION OF THE INVENTION

Figure 1:
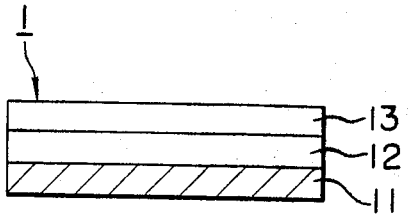
FIG. 1 is a greatly enlarged sectional view of the photosensitive material according to the present invention wherein 1 denotes the photosensitive material, 11 denotes a conductive substrate, 12 denotes a first photoconductive layer and 13 denotes a second photoconductive layer.

The photosensitive material according to the present invention, as illustrated in FIG. 1, comprises a conductive substrate 11 on which there is laminated a first photoconductive layer 12 having a sensitivity to at least Light A and a second photoconductive layer 13 capable of transmitting Light A as well as having a sensitivity to Light B, in that order.

The first photoconductive layer 12 or the second photoconductive layer 13 possesses the basic performances as described above, and additionally the photoconductive layer 12 or 13 may be allowed to have a both-chargeability concretely by using a composition consisting essentially of the under-mentioned combination 1 or 2.

1. Combinations of a substance generating charge (positive or negative conductive carrier) on absorbing Light A or Light B (namely; (1) coloring pigment, (2) coloring dye, (3) a combination of donor with acceptor causing the absorption of a charge transfer complex at a chromatic area or (4) a combination of non-coloring pigment with coloring dye) with a substance capable of transferring either positive or negative charge (namely; (a) P-type photoconductor or donor as a positive charge transfer substance or (b) N-type photoconductor or acceptor as a negative charge transfer substance). In this case, it is necessary for the above-mentioned combinations to meet the following conditions such as (i) high efficiency of generating charge on absorbing Light A or Light B, in other words high quantum efficiency, (ii) high efficiency of injecting either positive or negative charge to a charge transfer substance and (iii) high charge mobility of a charge transfer substance. In this connection it is to be noted that every substance referred to hereinafter can meet the above-mentioned conditions.
2. Co-existence of two kinds of charge transfer substances capable of transferring both positive and negative charges, namely a combination of N-type photoconductor with P-type photoconductor or a combination of donor with acceptor wherein either of the two is present in an excess quantity. In this instance, an excess donor or P-type photoconductor is required to possess a high hole mobility, while an excess acceptor or N-type photoconductor is required to possess a high electron mobility. The substances to be referred to hereinafter can meet this requirement.

The coloring pigments, non-coloring pigments, coloring dyes, donors, acceptors, P-type photoconductors and N-type photoconductors used herein will be exemplified as follows:

Coloring pigments (Group A)

Amorphous Se and same containing incorporated therein spectral sensitizers such as As, Te, etc.; cadmium sulfide and same doped with Cu; cadmium selenide, zinc sulfide; trigonal system selenium; azo pigments such as Sudan Red, Dian Blue, Genus Green B, etc.; quinone pigments such as Algol Yellow, pyrenequinone, Indanthrene Brilliant Violet RRP, etc.; indigo pigments such as indigo and thioindigo; bisbenzimidazole pigments such as Indo Fast Orange toner; phthalocyanine pigments such as Cu-phthalocyanine, etc.; quinacridone pigments; perylene pigments; etc.

Non-coloring pigments (Group A')

titanium dioxide, zinc oxide, etc.

Coloring dyes (Group B)

diphenylmethane dyes such as Oramin, etc.; triphenylmethane dyes such as Tetrabromophenol Blue, Crystal Violet, Malachite Green, etc.; xanthene dyes such as fluorescein, Rose Bengal, Rhodamine B, etc.; acridine dyes such as Acridine Orange, Acridine Yellow, etc.; azine dyes such as phenosafranine, Methylene Violet, etc.; thiazine dyes such as phenothiazine, Methylene Blue, etc.; pyrylium salts such as 1,3,5-triphenylpyrylium perchlorate, etc.; selena pyrylium salts such as 4-(4-dimethylaminophenyl)-2-phenylbenzo[b]selena pyrylium perchlorate, etc.; thia pyrylium salts such as 1,3,5-triphenyl thiapyrylium perchlorate, etc.; and so forth.

Acceptors (Group C)

This group includes carboxylic acid anhydrides; compounds having an electron-acceptable structure such as ortho or paraquinoid structure or the like; aliphatic cyclic compounds having electron-acceptable substituents such as nitro, nitroso, cyano groups; aliphatic compounds; heterocyclic compounds, etc., in more particular maleic anhydride, phthalic anhydride, tetrachlorophthalic anhydride, tetrabromophthalic anhydride, naphthalic anhydride, pyromellitic anhydride, chloro-p-benzoquinone, 2,5-dichlorobenzoquinone, 2,6-dichlorobenzoquinone, 5,8-dichloronaphthoquinone, O-chloranil, O-bromanil, p-chloranil, p-bromanil, p-iodanil, tetracyanoquinodimethane, 5,6-quinolinedione, coumarin-2, 2-dione, oxyindirubin, oxyindigo, 1,2-dinitroethane, 2-dinitropropane, 2-nitro-2-nitrosopropane, iminodiacetonitrile, succinonitrile, tetracyanoethylene, 1,1,3,3-tetracyanopropenyde, O-, m- or p-dinitrobenzene, 1,2,3-trinitrobenzene, 1,2,4-trinitrobenzene, 1,3,5-trinitrobenzene, dinitrodibenzil, 2,4-dinitroacetophenone, 2,4-dinitrotoluene, 1,3,5-trinitrobenzophenone, 1,2,3-trinitroanisole, $\alpha,\beta$-dinitronaphthalene, 1,4,5,8-tetranitronaphthalene, 3,4,5-trinitro-1,2-dimethylbenzene, 3-nitroso-2-nitrotoluene, 2-nitroso-3,5-dinitrotoluene, O-, m- or p-nitronitrosobenzene, phthalonitrile, terephthalonitrile, isophthalonitrile, benzoyl cyanide, bromobenzyl cyanide, quinoline cyanide, O-xylylene cyanide, O-, m- or p-nitrobenzil cyanide, 3,5-dinitropyridine, 3-nitro-2-pyridine, 3,4-dicyanopyridine, $\alpha$-, $\beta$- or $\gamma$-pyridine cyanide, 4,6-dinitroquinone, 4-nitroxanthone, 9,10-dinitroanthracene, 1-nitroanthracene, 2-nitrophenanthrenequinone, 2,5-dinitrofluorenone, 2,6-dinitrofluorenone, 3,6-dinitrofluorenone, 2,7-dinitrofluorenone, 2,4,7-trinitrofluorenone, 2,4,5,7-tetranitrofluorenone, 3,6-dinitrofluorenone-mandenonitrile, 3-nitrofluorenone-mandenonitrile, tetracyanopyrene, etc.

Low molecular weight donors (Group D)

This group includes compounds containing at least one group selected from an alkyl group such as a methyl group or the like, an alkoxy group, an amino group, an imino group and an imido group; or compounds having, at the main chain or side chain, polycyclic aromatic compounds such as anthracene, pyrene, phenanthrene, coronene etc. or nitrogen-containing cyclic compounds such as indole, carbazole, isooxazole, thiazole, imidazole, pyrazole, oxadiazole, thiadiazole, thiazole, etc.; in more particular as low molecular weight compounds, hexamethylenediamine, N-(4-aminobutyl)cadaverine, as-didodecyl hydrazine, p-toluidine, 4-amino-O-xylene, N,N'-diphenyl-1,2-diaminoethane, O-, m- or p-ditolylamine, triphenylamine, triphenylmethane such as 4,4'-bis(diethylamino)-2,2'-dimethyltriphenylmethane, durene, 2-bromo-3,7-dimethylnaphthalene, 2,3,5-trimethylnaphthalene, N'-(3-bromophenyl)-N-(β-naphthyl-)urea, N'-methyl-N-(α-naphthyl)urea, N,N'-diethyl-N-(α-naphthyl)urea, 2,6-dimethylanthracene, anthracene, 2-phenyl anthracene, 9,10-diphenylanthracene, 9,9'-bianthranil, 2-dimethylaminoanthracene, phenanthrene, 9-aminophenanthrene, 3,6-dimethylphenanthrene, 5,7-dibromo-2-phenylindole, 2,3-dimethylindoline, 3-indolylmethylamine, carbazole, 2-methylcarbazole, N-ethylcarbazole, 9-phenylcarbazole, 1,1'-dicarbazole, 3-(p-methoxyphenyl)oxazolidine, 3,4,5-trimethylisooxazole, 2-anilino-4,5-diphenylthiazole, 2,4,5-triaminophenylimidazole, 4-amino-3,5-dimethyl-1-phenylpyrazole, 2,5-diphenyl-1,3,4-oxadiazole, 1,3,5-triphenyl-1,2,4-triazole, 1-amino-5-phenyltetrazole, bis-diethylaminophenyl-1,3,6-oxadiazole, etc.

High molecular weight donors (Group E)

This group includes poly-N-vinylcarbazole and its derivatives (for example, those having halogen such as chlorine, bromine or the like and substituents such as methyl group, amino group, etc. at the carbazole structure), polyvinylpyrene, polyvinylanthracene, pyrene-formaldehyde condensation polymer and its derivatives (for example, those having halogen such as bromine or the like and subsituents such as nitro group, etc. at the pyrene structure)

P-type photoconductors utilized in the present invention include amorphous Se and phthalocyanine pigment, and as N-type photoconductors utilized in the present invention can be exemplified zinc oxide and cadmium sulfide.

Reference will be made to the quantities of aforesaid raw materials used. With reference to the charge generating substance in the preceding 1, in the case of the combination of donor with acceptor the suitable molar ratio is about 1:1, and in the case of the combination of non-coloring pigment with coloring dye the suitable weight ratio of dye to pigment is about $1:0.3-10^{-5}$ (by weight). On the other hand, the ratio of N-type photoconductor to P-type photoconductor in the case of the preceding 2 is preferred to be about 1:0.1–10 (by weight), and the ratio of acceptor to donor is preferred to be about 1:0.1–10 (by weight).

In this connection, the first and/or second photoconductive layer, which may be both chargeable or not, can be added with a binder and a plasticizer or with the spectral sensitizer selected from Group B and/or chemical sensitizers selected from Groups C and D in order to discriminate or separate the photosensitive wavelength regions of these photoconductive layers from each other.

The quantities of those agents used will be given below. The quantities of the coloring agents belonging to Group A (or A') to be used in the first and second photoconductive layers suitably are in the range of 1–70% by weight, preferably 5–40% by weight (wherein the evaporation products such as Se and Se-base alloys may be used in the percentage of 100). The weight ratio of the overall composition including the coloring or non-coloring pigment together with the spectral sensitizer belonging to Group B or chemical sensitizer belonging to Groups C and D to the photoconductive layer should be less than 70% by weight, the balance being the high molecular weight donor belonging to Group E which also acts as a binder or a usual binder. As the binder utilized herein, there can be enumerated polyethylene, polystyrene, polybutadiene, styrene-butadiene copolymer, acrylic ester or methacrylic ester polymer and copolymer, polyester, polyamide, polyimide, polycarbonate, epoxy resin, urethane resin, silicone resin, alkyd resin, vinyl-type resins such as polyvinyl chloride, polyvinyl acetate, polyvinyl pyrrolidone, etc., cellulose type resins such as nitrocellulose, acetylcellulose, etc., and a resin selected from the blend of these resins. The usual plasticizers such as dibutyl phthalate, dioctyl phthalate, etc. may be added in a quantity less than 30% by weight relative to the photoconductive layer.

As the exemplary both-chargeable photoconductive layers employed in the present invention can be enumerated those comprising the co-existence of the substances belonging to Group C with the substances belonging to Group D or Group E, preferably Group E, for instance, such as a photoconductive layer composed of substances constituting a charge transfer complex containing 2,4,7-trinitrofluorenone belonging to Group C and poly-N-vinylcarbazole belonging to Group E; a photoconductive layer comprising the co-existence of a substance belonging to Group A (or A') or Group B with that belonging to Group D or Group E; a photoconductive layer containing a cocrystalline complex composed of a pyrylium type dye such as pyrylium salt, thiapyrylium salt and selenapyrylium salt together with the triphenylmethane derivative belonging to Group D; a photoconductive layer comprising the co-existence of two kinds or more of substances belonging to Group A (or A'), for instance, such as zinc oxide and Cu-phthalocyanine; and so forth. Moreover, these photoconductive layers may be formed in the laminate type comprising a charge generating layer and a charge transfer layer, wherein each of the above photoconductive layers can be employed as the charge generating layer and a charge transfer layer is laminated thereon in which the compound belonging to Group C, D or E, i.e., a charge transfer substance is in the range of about 30–95% by weight, the balance being the aforesaid usual binder and plasticizer. In this instance, the charge generating layer may be formed into an evaporating or spattering layer of an inorganic photoconductive substance such as amorphous selenium or the like belonging to Group A and an organic photoconductive substance such as Cu-phthalocyanine and the like, or may be formed in the laminate type comprising the co-crystalline complex photoconductive layer utilized as the charge generating layer and a charge transfer layer, laminated thereon, which consists of the triphenylmethane derivative belonging to Group D such as bis-diethylaminophenyl-1,3,6-oxadiazole and the substance belonging to Group E or said usual binder such as poly-N-vinylcarbazole or polyester resin.

The first and second photoconductive layers are formed by dissolving or dispersing the above-mentioned constituents of each layer in toluene, tetrahydrofurane, 1,2-dichloroethane, benzene, methanol or the like, applying the resulting organic solvent onto the conductive substrate (or the first photoconductive layer) by means of a coating method such as air-knife coating, blade coating, dipping or the like, and drying.

On the other hand, for the purpose of imparting the commutating ability to the first photoconductive layer 12 in relation to the substrate, the substrate and/or photoconductive layer may be composed of the following specific raw materials: Se photoconductive layer evaporation-deposited onto an Al plate under specific conditions; $As_2Se_3$ evaporation-deposited onto the conductive substrate or conductive layer comprising a metal having 4.7 eV or more of work function, for instance, such as Pt, Au or Pd; and co-crystalline complex layer formed onto CuI-conductive substrate.

In this case, the use of the metal having 4.7 eV or more of work function permits a thorough injection of positively or negatively polarized charge from the substrate to the first photoconductive layer when effecting the first electrification, whereby there can be obtained a high electric potential capable of selectively separating colors from each other.

The composite photosensitive material according to the present invention, as hitherto explained, is a laminate type one which comprises the first photoconductive layer and the second photoconductive layer. With reference to the combination of these layers, even when either photoconductive layer has the both-chargeability or commutating ability, it is necessary that the first photoconductive layer should have a sensitivity to at least the chromatic light A, and the second photoconductive layer should be capable of transmitting said chromatic light A as well as have a sensitivity to another chromatic light B. On the supposition that the chromatic light A is red light and the chromatic light B is non-red visible light in this case, the photoconductive layers being sensitive to the respective lights can be classified as follows:

a. Red color-sensitive photoconductive layers ($\lambda \leqq 600$ nm) Photoconductive layers using blue photoconductive substances such as Dian Blue from among organic azo pigments, indigo from among indigo pigments, copper phthalocyanine from among phthalocyanine pigments, etc. belonging to Group A; photoconductive layers using, as spectral sensitizers for photoconductive substances, blue dyes such as Methylene Blue of thiazine dyes, 1,3,5-triphenylthiapyrylium perchlorate, Tetrabromophenol Blue, etc. of pyrylium type dyes belonging to Group B, for instance spectral-sensitizing of polyvinyl carbazole, etc. with said pyrylium type dyes and spectral-sensitizing of zinc oxide with Tetrabromophenol Blue of triphenylmethane dyes; and photoconductive layers composed of raw materials containing the co-crystalline complexes comprising pyrylium type dyes and polycarbonate.

b. Non-red color sensitive photoconductive layer ($\lambda < 600$ nm) Photosensitive layers using inorganic photoconductive substances such as amorphous Se, cadmium sulfide, cadmium selenide, zinc oxide, zinc sulfide, titanium dioxide (in particular, of rutile type), etc. or yellow, red organic photoconductive substances such as Algol Yellow of quinone pigments, Indo Fast Orange toner of bis-benzimidazole pigments, quinacridone pigments, part of perillene pigments, etc. belonging to Group 1; photosensitive layers containing, as spectral sensitizers for photoconductive substances, yellow and red dyes such as Oramin of diphenylmethane dyes, fluorescein and Rose Bengal of xanthene dyes, Acridine Orange, Acridine Yellow, etc. of acridine dyes, for instance those obtained by sensitizing zinc oxide with Rose Bengal; and further photosensitive layers composed of raw materials containing weak charge transfer complexes consisting of poly-N-vinylcarbazole, pyrene-formaldehyde condensates, etc. of the substances belonging to Group E and 2,6-dinitrofluorenone, etc. of the substances belonging to Group C.

c. Red color and non-red color sensitive photoconductive layers (c-1) Inorganic photoconductive layers comprising copper-doped cadmium sulfide, As- or Te-doped amorphous selenium, $As_2Se_2$, etc., and (c-2) Photoconductive layers composed of raw materials containing strong charge transfer complexes comprising the combinations of 2,4,7-trinitrofluorenone and 3,6-dinitrofluorenonemandenonitrile from among the substances belonging to Group C with poly-N-vinylcarbazole and pyrene-formaldehyde condensate from among the substances belonging to Group E.

Accordingly, either a or b is selected for the second photoconductive layer 13. On the other hand, for the first photoconductive layer 12 there is selected c, or b in case the second photoconductive layer 13 is a, or a in case the second photoconductive layer 13 is b. Still further, the concrete instances for imparting to the photoconductive layers a both-chargeability taking the above specific wavelength absorbability (wavelength separation ability or chromato-sensitivity) and a commutating ability with relation to the substrate will be shown as follows.

As the instances where the second photoconductive layer has a sensitivity to red light as well as a both-chargeability and where the first photoconductive layer has a sensitivity to nonred light there can be enumerated in the case of the second photoconductive layer the combinations of co-crystalline complex with polyacrylalkane such as triphenylmethane derivatives; blue pigment (for instance, Cu-phthalocyanine) with acceptor (for instance, 2,4,7-trinitrofluorenone), etc. In the case of the first photoconductive layer, on the other hand, there can be enumerated the aforesaid substances having a sensitivity to red light, for instance, such as amorphous Se, zinc sulfide and as forth.

In the application of the two-color process it is desirable for the purpose of better clarifying the difference between the surface potentials (electrostatic latent images), opposite in polarity to each other, corresponding to the two colored images of the two-color original that the sensitivity ratio of the second photoconductive layer whose surface was radiated with white light to the first photoconductive layer should be in the range between 1 or more and 20 or less, wherein the sensitivity of the second photoconductive layer is evaluated based on the white light per se but that of the first photoconductive layer is evaluated based on the white light whose partial wavelength has been absorbed when passing or filtering through the second photoconductive layer.

According to the present invention, at any rate, the composite photosensitive material for use in electrophotography is prepared by employing, as a conductive substrate, a conductor having a volume resistivity of less than $10^{10}$ Ωcm, for instance, a metal plate of Al, Cu, Pb or the like, a plate comprising metal oxide such as $SnO_2$, $In_2O_3$, CuI, $CuO_2$ or the like, or any one of glass, plastic film, paper and the like whose surface has been coated with said compound by evaporation or sputtering; and providing thereon a first photoconductive layer and a second photoconductive layer by means of the method of coating, evaporating or the like. The thickness of the first photoconductive layer, apart from its characteristics, suitably is in the range of 3–180 μm, preferably about 5–150 μm, and the thickness of the second photoconductive layer suitably is in the range of 3–50 μm, preferably about 5–30 μm. The organic solvent to be used in the course of preparation of the photosensitive material according to the present invention should be one capable of dissolving a binder. The organic solvent suitably used in the present invention includes for instance toluene, tetrahydropuran, dichloroethane, benzene, methanol, etc.

The electrophotographic process to be applied in the photosensitive material according to the present invention may be classified into the following three processes:

Process-I

The photosensitive material applied to this process comprises the first photoconductive layer 12 having a sensitivity to Light A and the second photoconductive layer 13 which is capable of transmitting Light A as well as has a sensitivity to Light B.

First, the first photoconductive layer 12 is subjected to the positive or negative first corona electrification with a polarity opposite to that to which the first photoconductive layer 12 has a sensitivity or with a polarity opposite to that of a charge injected from the substrate 11 to the first photoconductive layer 12, and thereafter is uniformly exposed to Light A alone or a light containing Light A but not Light B. This uniform exposure may be carried out simultaneously with the first electrification, but in case where the first photoconductive layer 12 is disposed to accept a charge injected from the substrate 11 at the time of said first electrification, the first electrification may be effected in the dark, dispensing the uniform exposure (FIG. 2-(a)).

Figure 2:
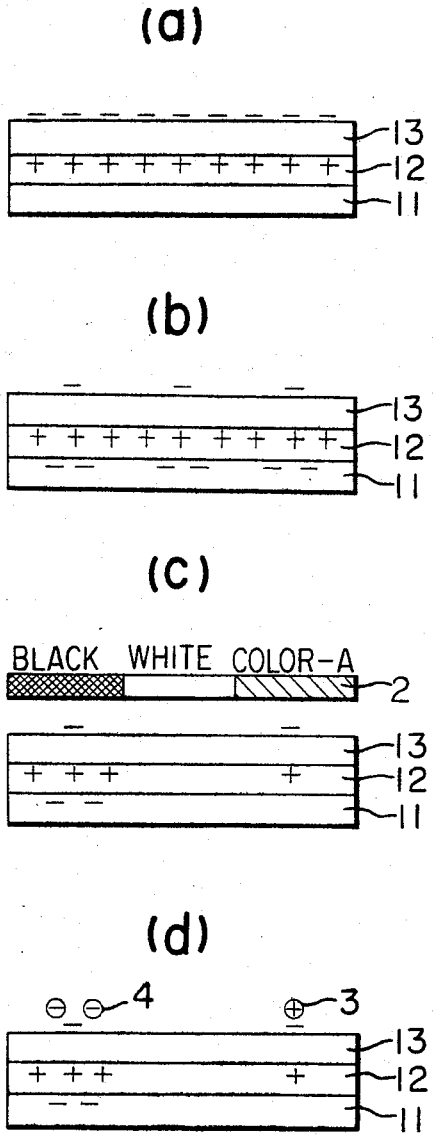
FIGS. 2(a) to 2(d), 4(a) to 4(d) and 6(a) to 6(d) are views for illustrating the electrophotographic process employing therein the photoconductive material according to the present invention.
Figure 3:
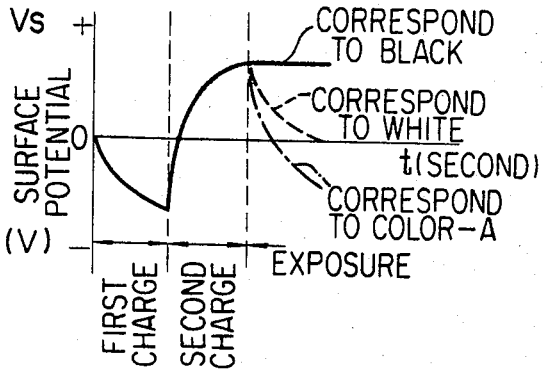
FIGS. 3, 5 and 7 are views for illustrating the characteristics of the photosensitive material according to the present invention.

Next, the light image of the original 2 subjected to the second corona electrification with a polarity opposite to that in the first electrification (FIG. 2-(b)) is imparted to this photosensitive material. In this case, the second electrification is effected with an electric potential somewhat lower than that in the first electrification. At this time, the portion of the photosensitive material corresponding to the black area of the original 2 does not undergo any change in the charge distribution but the charge distribution at the portion of the photosensitive material corresponding to the white area of the original changes to render both the first and second photoconductive layers 12, 13 conductive, whereby the charge thereat dissipates. On the other hand, at the portion of the photosensitive material corresponding to the chromatic area of the original 2, for instance, Color A area, although the first photoconductive layer 12 is rendered conductive, there remains on the second photoconductive layer a part of the charge (FIG. 2-(c)). Thus, on each of the photoconductive layers 12 and 13 of the photosensitive material are formed electrostatic latent images which correspond to the black and chromatic areas of the original 2 and have a polarity different from each other. These latent images are successively developed with chromatic toner 3 and black toner 4, whereby a two-color copy is obtained (FIG. 2-(d)). In this connection, FIG. 3 illustrates the conditions of surface potential of the photosensitive material with the passing of time.

In the above explanation, the polarity of the first electrification is negative and that of second electrification is positive, but the same results may be obtained when the charge polarity is the inverse.

Process-II

The photosensitive material applied to this process comprises the first photoconductive layer 12 having a sensitivity to Light B and the second photoconductive layer 13 which is capable of transmitting Light B as well as has a sensitivity to Light A.

The photosensitive material having such a disposition is subjected to positive or negative first corona electrification with the same polarity as that to which the second photoconductive layer 13 exhibits a sensitivity. At this time, the uniform exposure for rendering the second photoconductive layer 13 conductive with Light A is carried out simultaneously with or just after the electrification. In case where the second photoconductive layer 13 has a property of transferring the charge at the time of the first electrification, however, the first electrification may be effected in the dark, dispensing the uniform exposure (FIG. 4-(a)).

Figure 5:
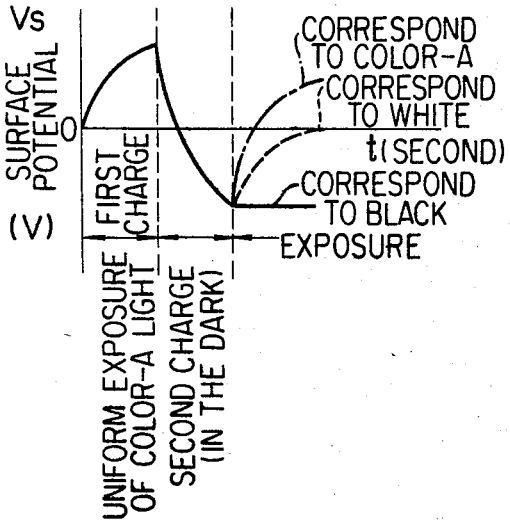
Figure 4:
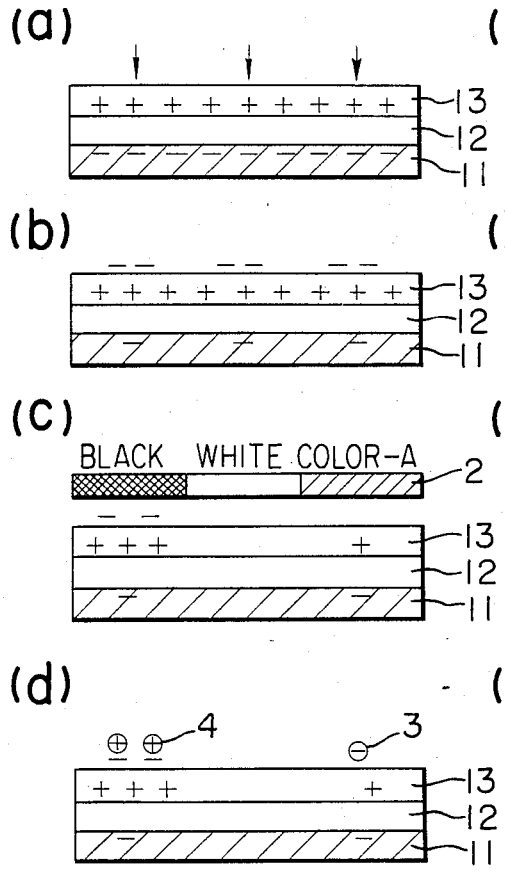

Next, the photosensitive material is subjected to the second corona electrification with a polarity opposite to that in the first electrification (FIG. 4-(b)), and thereafter the light image of the original is imparted to this photosensitive material. In this case, the second electrification is effected with an electric potential somewhat lower than that in the first electrification. At this time, the portion of the photosensitive material corresponding to the black area of the original 2 does not undergo any change in the charge distribution but the charge distribution at the portion of the photosensitive material corresponding to the white area of the original changes to render both the first and second photoconductive layers 12, 13 conductive, whereby the charge thereat dissipates. On the other hand, at the portion of the photosensitive material corresponding to the chromatic area of the original 2, for instance, Color A area, although the second photoconductive layer 13 is rendered conductive, there remains onto the first photoconductive layer a part of the charge (FIG. 4-(c)). Thus, on the photosensitive material there are formed electrostatic latent images which correspond to the black and chromatic areas of the original 2 and have a polarity different from each other. These latent images are successively developed with chromatic toner 3 and black toner 4, whereby a two-color copy is obtained (FIG. 4-(d)). This process is advantageous in that the black image area takes the form of external latent image (latent image formed on the second photoconductive layer). In this connection, FIG. 5 illustrates the conditions of surface potential of the photosensitive material with the lapse of time throughout this process.

Process-III

The photosensitive material applied to this process comprises the first photoconductive layer 12 which has a sensitivity to Light B as well as is devised to accept the injection of charge to one charge polarity at the time of electrification, and the second photoconductive layer 13 which is capable of transmitting Light B as well as has a sensitivity to Light A.

Figure 6:
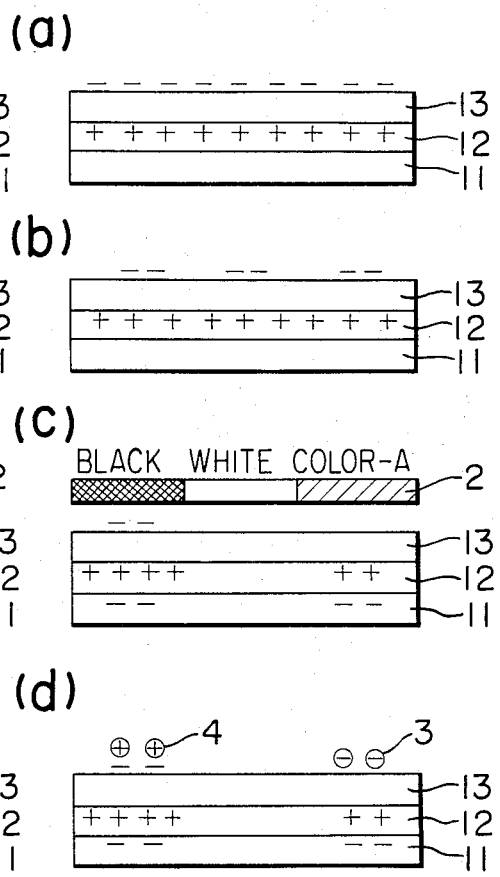
Figure 7:
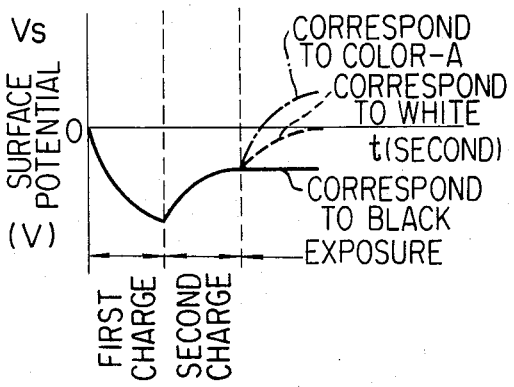

Accordingly, the thus constructed photosensitive material is subjected to the first corona electrification in the dark with a polarity opposite to that of a charge from the substrate 11 to the first photoconductive layer 12 and to which the second photoconductive layer 13 exhibits a sensitivity (FIG. 6-(a)). Next, the photosensitive material is subjected to the second corona electrification with a polarity opposite to that in the first electrification (FIG. 6-(b)), and thereafter the light image of the original 2 is imparted to this photosensitive material. In this case, the second electrification is effected with an electric potential somewhat lower than that in the first electrification. At this time, the portion of the photosensitive material corresponding to the black area of the original 2 does not undergo any change in the charge distribution but the charge distribution at the portion of the photosensitive material corresponding to the white area of the original changes to render both the first and second photoconductive layers 12, 13 conductive, whereby the charge thereat dissipates. On the other hand, at the portion of the photosensitive material corresponding to the chromatic area of the original 2, for instance, Color A area, although the second photoconductive layer 13 is rendered conductive, there remains onto the first photoconductive layer a part of the charge (FIG. 6-(c)). Thus, on the photosensitive material there are formed electrostatic latent images which correspond to the black and chromatic areas of the original and have a different polarity respectively. These latent images are successively developed with chromatic toner 3 and black toner 4 to thereby obtain a two-color copy (FIG. 6-(d)). This process is advantageous in that the black image area takes the form of an external latent image. In this connection, FIG. 7 illustrates the conditions of surface potential of the photosensitive material with the passing of time throughout this process.

In explaining the above three processes, the polarity of the first electrification is negative and that of the second electrification is positive, but if the conditions are satisfied, even when the charge polarity is made inverse there may be obtained the same results.

Furthermore, the photosensitive material according to the present invention is applicable to not only said Processes-I, II and III as above-mentioned but also conventional Carlson process. The original employed herein may be not only the two-color original revealed in the aforesaid embodiments but also multicolor ones such as three-color or more. When copying is effected using this multi-color original through the above-mentioned two-color reproduction process, there can be obtained a two-colored copy, although a shade of color is caused between the respective chromatic areas. On the other hand, when this multi-color original is applied to Carlson process (monochro reproduction) there can be obtained a white and black image-carrying copy with a conspicuous difference in image density between the respective chromatic areas.

DESCRIPTION OF THE PREFERRED EMBODIMENTS

In the Examples given hereinafter, the parts are by weight.

EXAMPLE 1

An aluminum evaporation-coated polyester film was employed as a conductive substrate, and a first conductive layer was formed on this aluminum evaporation coated surface in the following manner. First, amorphous Se was coated on the evaporation-coated surface by evaporation, thereby obtaining a charge generating layer having a thickness of 1 μm.

Then, on this layer was applied a solution obtained by 5 parts of polycarbonate resin and 5 parts of 1,1-bis(P-N,N-dibenzylaminophenyl)propane in 90 parts of methylene chloride, and the same was dried at 80° C. for 10 minutes, whereby a charge transfer layer having a thickness of about 5 μm was formed to be a first photoconductive layer.

Next, 25 parts of β type copper phthalocyanine, 68 parts of poly-N-vinylcarbazole and 7 parts of polyester resin were added to 90 parts of tetrahydrofuran, and the mixture was subjected to 5 hours' pulverizing and stirring treatment in a ball mill, and then was extensively applied onto the first photoconductive layer. The same was air-dried for 5 minutes and thereafter thermally dried for 10 minutes in an air bath heated to 110° C., thereby obtaining a second photoconductive layer having a thickness of about 4 μm.

A composite photosensitive material comprising the above-mentioned first and second photoconductive layers was electrified in the dark with −6.3 KV corona discharge by means of a modified copying machine FT-6400 (manufactured by Ricoh Co., Ltd. wherein the exposure slit width and drum linear speed have been changed so that the quantity of exposure light required for a halogen lamp may be 30 lux.sec.), and was subjected to imagewise exposure using an original comprising black, red, blue and white areas, followed by an automatic developing operation with a black toner. As a result, the red and blue areas of the original were also reproduced as a black image having a lower concentration as compared with that of the black area, while the white area was reproduced as a white image freed from background stains, whereby there was formed a distinct white and black colored image having a high contrast as a whole.

EXAMPLE 2

An aluminum evaporation-coated polyester film was employed as a conductive substrate, and a first conductive layer was formed on this aluminum evaporation-coated surface in the following manner. 25 parts of β type copper phthalocyanine, 68 parts of poly-N-vinylcarbazole and 7 parts of polyester resin were added to 900 parts of tetrahydrofuran, and the mixture was subjected to 5 hours' pulverizing and stirring treatment in a ball mill, and then was extensively applied onto the conductive substrate. The same was air-dried for 5 minutes and thereafter thermally dried for 10 minutes in an air bath heated to 110° C., thereby obtaining a first photoconductive layer having a thickness of 8 μm. Next, 1 hour's ultrasonic dispersion was effected for the purpose of dissolving or dispersing 5 parts of conductive CdS and 5 parts of styrene-butadiene copolymer resin in 100 parts of toluene. The resulting coating liquid was extensively applied onto the first photoconductive layer, thereby forming a charge generating layer having a thickness of about 4 μm.

Furthermore, onto this layer was extensively applied a solution obtained by dissolving 5 parts of 2,5-bis(P-diethylaminophenyl)-1,3,4-oxadiazole and 5 parts of polyester resin in 90 parts of tetrahydrofuran and stirring. The same was air-dried for 5 minutes, and then thermally dried for 10 minutes in an air bath heated to 110° C., whereby a charge transfer layer having a thickness of about 10 μm was formed to be a second photoconductive layer.

A composite photosensitive material comprising the above-mentioned first and second photoconductive layers was subjected to −6.3 KV corona electrification in the dark by means of the copying machine utilized in Example 3, and was further subjected to imagewise exposure using an original comprising black, red, blue and white areas, followed by an automatic developing operation with a black toner. As a result, the red and blue areas of the original were also reproduced as a black image having a lower concentration as compared with that of the black area, while the white area was reproduced as a white image freed from background stains, whereby there was formed a distinct white and black colored image having a high contrast as a whole.

EXAMPLE 3

An amorphous selenium having a purity of 99.99% was coated on an aluminum substrate at 65° C. by evaporation to thereby obtain a first photoconductive layer being 15 μm in thickness.

Next, 1 part of β-copper phthalocyanine and 4 parts of acrylic resin were added to 95 parts of tetrahydrofuran, and the same was pulverized and stirred for 5 hours in a ball mill. Then, it was extensively coated on the first photoconductive layer, air-dried for 5 minutes, and thereafter thermally dried for 30 minutes in an air bath heated to 50° C., thereby forming a second photoconductive layer having a thickness of about 7 μm. Subsequently, the thus obtained composite photosensitive material was subjected to +6.3 KV corona electrification in the dark by means of the copying machine utilized in Example 1, and was further subjected to imagewise exposure using an original comprising black, red, blue, and white areas, followed by an automatic developing operation with a black toner. As a result, the red and blue areas of the original were also reproduced as a black image having a lower concentration as compared with that of the black area, while the white area was reproduced as a white image freed from background stains, whereby there was formed a distinct white and black colored image having a high contrast as a whole.

EXAMPLE 4

A co-crystalline complex was prepared by mixing a solution comprising 0.2 g of 4-(4-dimethylaminophenyl)-2,6-diphenylpyrylium perchlorate, 0.2 g of polycarbonate, 15 g of 1,2-dichloromethane and 5 g of dichloroethane. Next, 0.1 g of this co-crystalline complex was mixed with 0.3 g of vinylbutyral resin and 2 g of toluene, and the same was kneaded for 23 hours in a ball mill. Moreover, this kneaded product was added to a solution obtained by adding 0.2 g of 1-phenyl-3-(p-dimethylaminostyryl)pyrazoline to 2 g of 1,2-dichloroethane, and the same was kneaded for 5 hours to prepare a photosensitive composition.

On the other hand, on an aluminum substrate was formed a first photoconductive layer which has scarcely a sensitivity to red color by coating said substrate with Se to a thickness of 50 μm.

Next, said photosensitive composition was applied onto this photoconductive layer with a blade and dried to thereby form a second photoconductive layer having a thickness of 15 μm. Thus, there was obtained an electrophotographic photosensitive material comprising the first and second photoconductive layers.

The thus obtained photosensitive material was stored in the dark for a whole day and night, then subjected to +6 KV corona discharge to the surface of the photosensitive material and successively −6 KV corona discharge to same thereby to positively electrify both the first and second photoconductive layers as a whole. Thereafter by employing, as an original, a red and black characters-carrying film, a tungsten light of 20 lux was radiated onto the photosensitive material for 1 second from above this film. The surface potential Vo of the photosensitive material at this time, the potential corresponding to the white area after the lapse of 15 seconds Vw, the potential corresponding to the red area after the lapse of 15 seconds Vr and the potential corresponding to the black area after the lapse of the photosensitive material respectively are as shown in Table-1.

TABLE 1

| $V_O$ (V) | $V_W$ (V) | $V_R$ (V) | $V_B$ (V) |
|---|---|---|---|
| −950 | +20 | +300 | −900 |

Next, the photosensitive material in these potential conditions was developed with a two component type black developer and successively a red developer in accordance with the magnet brush method and was uniformly electrified so as to have a negative polarity. Thereafter, the images were transferred onto a common paper according to the corona transfer method, thereby obtaining images having the density and resolving power as shown in Table-2.

TABLE 2

| Black image density | Red image density | Resolving power (lines/mm) |
|---|---|---|
| 1.2 | 1.0 | 7 |

EXAMPLE 5

1 part of CdS, 1 part of polyester and 10 parts of tetrahydrofuran were subjected to ultrasonic dispersion. This dispersion was applied onto a 0.2 mm-thick Al plate by means of a blade, and the same was hot air-dried at 150° C. for 30 minutes to form a 10μ-thick first photoconductive layer. On the other hand, 1 part of copper phthalocyanine, 3 parts of polyester and 10 parts of tetrahydrofuran were dispersed in a ball mill. This dispersion was applied onto said first photoconductive layer by means of a blade, and was dried at 100° C. for 1 hour to form a 20μ-thick second photoconductive layer.

The thus obtained electrophotographic photosensitive material was subjected to a first electrification with +6.0 KV while exposing it to the light from a 100 W tungsten lamp through a red filter, and thereafter to a second electrification with −4.5 KV in the dark. Successively, a red, white and black images-carrying original is overlapped thereon, and the same was exposed to the light from a 100 W tungsten lamp, and thereafter was developed with a two component system positively charged dry black developer and then a two component system negatively charged dry red developer in the dark, whereby images were reproduced corresponding to the red, white and black images carried on the original.

EXAMPLE 6

A 10μ-thick selenium layer which is scarcely sensitive to red color was formed on a 0.2 mm-thick Al plate by evaporation at normal temperature to be a first photoconductive layer. Thereafter, the same was applied by means of a blade with a mixed liquid comprising 1 part of polyvinylcarbazole, 0.2 part of 2,4,7-trinitrofluorenone (TNF), 0.5 part of polyester, 5 parts of tetrahydrofuran and 0.001 part of silicone oil, and the same was dried at 50° C. for 2 hours, whereby a second photoconductive layer having a thickness of 10 μm was formed.

As the result of having developed the obtained electrophotographic photosensitive material through the same procedure as Example 1 there were obtained the red, white and black copied images corresponding to those carried on the original. Referring to the surface potential of the photosensitive material at this time, the surface potentials at the black, red and white areas were −450 V, +250 V and +50 V respectively.

EXAMPLE 7

An Al substrate was coated with selenium to a thickness of about 20 μm by vacuum evaporation while holding the substrate temperature at 45° C. to thereby form a first photoconductive layer. This one does not exhibit a photoconductivity to the long wavelength region over 600 nm. Next, onto the first photoconductive layer was applied a solution of the following composition by means of the blade method:

4-p-dimethylaminophenyl-2,6-diphenylthiapyrylium perchlorate: 0.2 part
4,4'-bis(diethylamino)-2,2'-dimethyltriphenyl methane: 2.0 parts
polycarbonate resin: 2.8 parts
methylene chloride: 55 parts The same was dried at 50° C. for 5 minutes to thereby form a 2 μm-thick charge generating layer for use in a second photoconductive layer. Onto this layer, further, was applied a solution of the following composition by means of the blade method:

4,4'-bis(dimethylamine)-2,2'-dimethyltriphenyl methane: 2.0 parts
polycarbonate resin: 2.0 parts
methylene chloride: 36 parts This was dried at 50° C. for 20 minutes to form a charge transfer layer having a thickness of about 50 μm, whereby a second photoconductive layer was obtained.

The thus prepared composite photosensitive material was subjected to a first positive electrification (+6.0 KV) while exposing it to the light from a 100 W tungsten lamp through a red filter, and thereafter to a second negative electrification (−4.5 KV). Additionally, a pattern comprising red, white and black areas was radiated with a 100 W tungsten lamp to thereby form electrostatic latent images. These were developed successively with a black developer and then a red developer, whereby on the surface of the photosensitive material were formed red and black toner images corresponding to the red and black areas of original. These toner images were transferred to a common paper and fixed by heating, thereby obtaining a distinct two-colored image on the common paper.

EXAMPLE 8

A composite photosensitive material was prepared by repeating the same procedure as Example 7 except that a charge generating layer for use in the second photoconductive layer was made to have a thickness of about 1.5 μm by applying a solution of the following composition by means of the blade method and drying at 50° C. for 5 minutes and the thickness of the first photoconductive layer (selenium layer) was about 7 μm:

4-p-dimethylaminophenyl-2,6-diphenylthiapyrylium perchlorate: 0.3 part
4,4'-bis(diethylamino)-2,2'-dimethyltriphenyl methane: 1.9 parts
polycarbonate resin: 2.8 parts
dichloroethane: 55 parts This photosensitive material was subjected to the same copying operation as Example 7 to obtain the substantially same results.

EXAMPLE 9

A composite photosensitive material was prepared by repeating the same procedure as Example 7 except that a first photoconductive layer was made to have a thickness of about 20 μm by applying a solution of the following composition by means of a blade method and drying at 100° C. for 10 minutes. This photosensitive material was subjected to the same copying operation as Example 7 except that it was firstly electrified negatively (−6 KV) with exposure to a red light and secondarily electrified positively (+4.5 KV) in the dark to thereby obtain the substantially same results.

CdS powder: 10 parts
styrene-butadiene copolymer: 5 parts
toluene: 20 parts

EXAMPLE 10

Dian Blue (Color Index CI 21180): 15 parts
2,5-bis-diethylaminophenyl-1,3,5-oxadiazole: 32 parts
poly-γ-carbazolylethyl-L-glutamate: 53 parts
tetrahydrofuran: 950 parts The above components were prepared for a first photoconductive layer-forming liquid. First, Dian Blue was mixed with tetrahydrofuran, and this mixture was pulverized more than 3 hours in a ball mill. This was applied onto an Al plate by means of the blade method, and air-dried for 5 minutes and further dried at 100° C. for 10 minutes, whereby there was formed a layer having a thickness of 10 μm. Next, a composition of the undermentioned components was dispersed for 10 minutes by means of a homogenizer, then the resulting dispersion was applied onto said first photoconductive layer by means of the blade method, and dried at 100° C. for 10 minutes, thereby forming a second photoconductive layer having a thickness of about 15μ:

zinc oxide: 40 g
acrylic resin: 40 g
Rose Bengal ($4\times10^{-5}$ mole/ml methane solution): 8 g
toluene: 200 ml Upon measuring the properties of the thus obtained first photoconductive layer by means of a paper analyzer, it exhibited a high sensitivity, showing that the saturated potential Vs was 1080 V and the quantity of exposure light E ½ required for until the potential at the time of exposure Vo=760 V was reduced to ½ was 2.3 lux.sec.

Next, the thus obtained photosensitive material was uniformly exposed to the light from a 100 W red fluorescent lamp and thus subjected to a first negative electrification (−6.2 KV) and then to a second positive electrification (+6.2 KV). The first and second charged potentials of the photosensitive material at this time were −1100 V and +800 V respectively.

Next, an original obtained by entering red-and black-inked informations on a white common paper was exposed to a white light, and the reflected light was focussed on the photosensitive material through a lens system to thereby effect the radiation of the light image carried on the original. Consequently, on the photosensitive material was formed the following surface potential distribution, that is, the surface potential distribution at the area corresponding to the red color was −250 V, that corresponding to the black color +300 V, and that corresponding to the white color −50 V respectively.

Further, the latent images having the above development potentials were developed with a negatively charged black developer and a positively charged red developer in that order by means of the magnet brush method. The thus obtained visible images were transferred onto a transfer sheet and fixed to obtain a distinct two-colored (red and black) image which was high in tone and freed from mixed-color.

EXAMPLE 11

A co-crystalline complex solution comprising the undermentioned components was applied onto an Al plate by means of the blade method, and dried at 80° C. for 2 minutes, thereby forming a first photoconductive layer having a thickness of 25 μm:

4-p-dimethylaminophenyl-2,6-diphenylthiapyrylium perchlorate: 4 parts 4,4'-bis(diethylamino)-2,2'-dimethyltriphenyl methane: 40 parts polycarbonate (Panlite K-1300 manufactured by TEIJIN K.K.): 56 parts dichloromethane: 1000 parts Next, 5 parts of CdS, 5 parts of styrene-butadiene copolymer and 100 parts of toluene were subjected to ultrasonic dispersion for 1 hour. Then, the resulting dispersion was applied extensively onto said first photoconductive layer air-dried for 5 minutes, and successively thermally dried at 100° C. for 30 minutes, whereby there was formed a charge generating layer having a thickness of about 3 μm. On this layer, furthermore, was extensively applied a solution comprising the undermentioned components:

Polyester adhesive 49000 (manufactured by Du Pont): 5 parts 2,5-bis-diethylaminophenyl-1,3,5-oxadiazole: 5 parts tetrahydrofuran: 90 parts The same was then air-dried for 5 minutes and further thermally dried at 110° C. for 1 hour to form a charge transfer layer having a thickness of about 10 μm, whereby a composite photosensitive material was prepared.

For comparison sake, on the other hand, a control composite photosensitive material was prepared by repeating the procedure of the present Example except that the first photoconductive layer was formed by evaporation-coating of Se (94 wt.%)—Te (6 wt.%) alloy.

Next, the photosensitive material of this Example was negatively electrified (−6.2 KV) while exposing it uniformly to the light from a 10 W red fluorescent lamp. And the control one was also negatively electrified (−6.2 KV) under the same conditions. Subsequently, both photosensitive materials were subjected to a second positive electrification (+5.4 KV), wherein the charged potential of the photosensitive material was +650 V in the present Example and +800 V in the control case.

These photosensitive materials were subjected to imagewise exposure through the same procedure as Example 7. The obtained surface potential distribution of each photosensitive material was as shown below:

| | The area corresponding to red color (V) | The area corresponding to black color (V) | The area corresponding to white background |
|---|---|---|---|
| Example 11 | −400 | +600 | −50 |
| Control | −200 | +760 | −60 |

It was proved that a higher red development potential was applicable to the co-crystallizing complex type photoconductive layer-provided photosensitive material disclosed in this Example than the Se-Te alloy type photoconductive layer-provided control one. Further, it was found that the same results as Example 10 were obtained when the electrostatic latent images formed on the photosensitive material of this Example were made visible with a developer prepared by dispersing a negatively charged black toner and a positively charged red toner in a dispersion medium and said visible images were transferred onto a transfer sheet and fixed.

EXAMPLE 12

40 g of zinc oxide, 8 g of Rose Bengal ($4\times10^{-5}$ mole/50 ml methanol solution), 200 ml of toluene and 40 g of acrylic resin were dispersed for 10 minutes in a homogenizer. The resulting dispersion was applied onto the first photoconductive layer formed in Example 11 by means of the blade method and dried at 100° C. for 10 minutes to form a second photoconductive layer having a thickness of about 20 μm.

The resulting photosensitive material was electrified and exposed through the same procedure as Example 11 with the result that at the time when 10 seconds had passed after said exposure the charged potential corresponding to the white area was −80 V, the charged potential corresponding to the red area was −200 V and that corresponding to the black area was 600 V.

Next, the latent images formed on this photosensitive material were developed under this condition and through the same procedure as Example 11 to thereby obtain a two-colored image having a black concentration of 0.8 and a red concentration of 0.6.

EXAMPLE 13

1 part of 8-hydroxyquinoline with $Bi^{3+}$, 1 part of acrylic resin and 18 parts of toluene were dispersed for 2 hours in a ball mill. The resulting dispersion was applied onto the first photoconductive layer formed in Example 11 by means of the blade method, and the same was dried at 50° C. for 1 hour to thereby form a second photoconductive layer having a thickness of about 15 μm. The thus obtained photosensitive material was left standing in the dark for 12 hours, and then was subjected to a first negative electrification (−6 KV) so as to have a charged potential of −1200 V. This photosensitive material was subjected to a second positive electrification (+6 KV) so as to have a charged potential of +600 V, and then was subjected to a cycle of exposure, development, transfer and fixation according to the same procedure as Example 10, whereby there were obtained good results as seen in Example 10.

EXAMPLE 14

Au was vacuum-evaporated on a 0.5 mm-thick Al plate to a thickness of 0.5 μm to prepare a conductive substrate. On the resulting substrate held at 230° C. was vacuum-evaporated $As_2Se_3$ to form a first photoconductive layer having a thickness of 45 μm. Next, for the purpose of measuring the dark decay characteristic of this first photoconductive layer, it was subjected to −5.5 KV corona discharge by means of a commercially available paper analyzer so as to have a charged potential of −200 V and left standing in the dark. As a result, the initial charged potential became zero volt before the passage of 2 seconds, exhibiting its superior dark decay characteristic.

Next, on this substrate, while held at 50° C., was spattered CdS to a thickness of 0.8 μm, whereby there was formed a charge generating layer for use in a second photoconductive layer. Further, a 5 wt.% methylene chloride solution of polyvinylcarbazole was applied onto this layer and dried to form a 13 μm-thick charge transfer layer for use in a second photoconductive layer, whereby there was prepared a composite photosensitive material.

For comparison sake, on the other hand, an $As_2Se_3$ alloy-made first photoconductive layer was provided directly on a 0.5 mm-thick Al plate according to the aforesaid procedure. The thus prepared one was subjected to corona discharge with −5.5 KV so as to have a charged potential of −290 V, but due to its inferior dark decay characteristic it was left standing for 20 seconds in the dark with the result that the initial potential was only lowered to −112 V. A control composite photosensitive material was prepared in the manner of providing, on this first photoconductive layer, a second photoconductive layer comprising a charge generating layer and a charge transfer layer through the same procedure as the present Example.

Next, these photosensitive materials were respectively subjected a first corona discharge with −6.0 KV and then a second corona discharge with +5.5 KV. Successively, each of them was subjected to each process of (1) 2 seconds' dark decay, (2) 2 seconds' radiation of a light of 7 lux and (3) 2 seconds' radiation of a light of 7 lux through a red filter so as to correspond to the black area, red area and white area of the original after the completion of imagewise exposure. And the surface potential at each time was measured. The obtained results were as shown in the following table.

| Process | Control Example | Example 14 |
|---|---|---|
| (1) | +260 | +280 |
| (2) | −20 | −10 |
| (3) | −240 | −350 |

It is seen from this table that the separation potential [in the table, the difference between (1) and (2) and the difference between (2) and (3)] in the case of the present Example is high as compared that in the control one. The reason therefor is considered to consist in that the use of a metal having 4.7 eV or more of work function in the photoconductive layer of the substrate according to the present Example has permitted the sufficient injection of positively polarized carriers from the substrate to the first photoconductive layer at the time of effecting the first electrification.

Next, using either Pd or Pt in place of Au of the present Example, two photosensitive materials were prepared. The thus obtained photosensitive material each was left standing in the dark for 12 hours, and then was subjected to a first negative electrification (−6 KV) so as to have a charged potential of −1350 V. This photosensitive material was subjected to a second positive electrification (+6 KV) so as to have a charged potential of +580 V, and then was subjected to a cycle of exposure, development, transfer and fixation according to the same procedure as Example 10, whereby there were obtained good results as seen in Example 10.

EXAMPLE 15

An aluminum evaporation-coated polyester film was employed as a conductive substrate, and on this aluminum evaporation-coated surface was formed a first photoconductive layer in the following manner.

The electrophotographic sensitivity E 1/10 (the quantity of exposure light required until the saturated surface potential is reduced to 1/10) of the first photoconductive layer in the case where the second photoconductive layer was allowed be present together with the first photoconductive layer at the time of exposure, namely when exposure is effected by using, as a filter the one comprising a glass substrate and the second photoconductive layer provided thereon was measured under the conditions: photosensitive surface intensity 20 lux, corona discharge −6 KV, and was evaluated to be 72 lux.sec.

A mixture of the undermentioned components was dissolved in 90 parts of tetrahydrofuran and stirred. The resulting solution was extensively applied onto a conductive substrate, air-dried for 5 minutes and thermally dried for 10 minutes in an air bath heated to 90° C., thereby obtaining a first photoconductive layer having a thickness of about 17 μm:

poly-N-vinylcarbazole: 54 parts
2,4,7-trinitrofluorenone: 40 parts
polyester resin: 6 parts Further, 8 parts of β-copper phthalocyanine and 1 part of polyester resin were added to 96 parts of tetrahydrofuran. The same was pulverized and stirred for 5 hours in a ball mill. Then, it was applied extensively onto the first photoconductive layer, air-dried for 5 minutes, and thereafter thermally dried for 10 minutes in an air bath heated to 90° C., thereby forming a charge generating layer having a thickness of about 0.5 μm. Finally, onto this layer was extensively applied a solution obtained by dissolving 5 parts of polyvinylcarbazole and 5 parts of

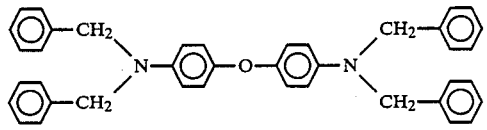

in 90 parts of tetrahydrofuran and stirred, air-dried for 5 minutes and subjected to 10 minutes' thermal drying in an air bath heated to 90° C., whereby there was formed a charge transfer layer having a thickness of about 16 μm to be a second photoconductive layer. The second photoconductive layer alone was measured in respect of E 1/10 under the conditions where the first photoconductive layer had been subjected to exposure and electrification (wherein, however, the filter was absent and the charged polarity was plus) with the result that E 1/10 was 27 lux.sec. and the ratio of sensitivity between both photoconductive layers was 2.7.

The composite photosensitive material comprising the first and second photoconductive layers was subjected to corona discharge with −6.3 KV while undergoing the overall exposure to a blue light, and successively corona discharge with +5.2 KV in the dark for reducing the surface potential to zero substantially. Thereafter, the white area of the photosensitive material was subjected to 1 second's imagewise exposure through an original comprising red, blue, black and white patterns by means of a 100 W halogen lamp, and then developed with a positively charged blue toner and a negatively charged red toner. The result was that the distinct and high-contrast blue and red colored images were obtained corresponding to the blue and red areas of the original, but the black and white areas of the original were reproduced as a background stain-free white area.

Furthermore, the photosensitive material was subjected to the same electrification process, then was imagewisely exposed for 1 second to the light from a 100 W halogen lamp using an original comprising white and black negative patterns through a blue filter, and was developed with a positively charged black toner, whereby there was obtained a distinct and high-contrast reversal positive image freed from background stains.

The same procedure as above-mentioned was repeated except that the blue filter was replaced by a red filter and the positively charged black toner was replaced by a negatively charged black toner to thereby obtain a distinct and high-contrast reversal positive image freed from background stains.

EXAMPLE 16

An aluminum evaporation-coated polyester film was employed as a conductive substrate. Then, on this aluminum evaporation-coated surface was formed a first photoconductive layer in the following manner. The first photoconductive layer was measured in respect of the electrophotographic sensitivity E 1/10 under the same conditions as Example 15 inclusive of a filter comprising the provision of a second photoconductive layer to be referred to hereinafter on a glass substrate (wherein, the charged polarity is plus) to find that the E 1/10 value was 30 lux.sec.

20 parts of β type-copper phthalocyanine and 40 parts of acrylic resin were added to 540 parts of tetrahydrofuran and the same was pulverized and stirred for 5 hours in a ball mill. 30 parts of zinc oxide and further 270 parts of tetrahydrofuran were added to 300 parts of this dispersion, and the mixture was dispersed and stirred for 10 minutes by means of a homogenizer. This was extensively coated on the photoconductive substrate, air-dried for 5 minutes and then thermally dried for 10 minutes in an air bath heated to 90° C., thereby obtaining a first photoconductive layer having a thickness of about 80 μm.

Amorphous Se was coated thereon by evaporation to a thickness of 1 μm, thereby obtaining a charge generating layer. Moreover, a solution obtained by dissolving 5 parts of polycarbonate resin and 5 parts of 1,1-bis(p-N,N-dibenzylaminophenyl)propane in 90 parts of methylene chloride was applied onto said layer, and dried at 80° C. for 10 minutes, whereby a charge transfer layer having a thickness of about 10 μm was formed to be a second photoconductive layer. The second photoconductive layer alone was measured in respect of E 1/10 under the same exposure and electrification conditions for the first photoconductive layer (wherein, however, the charged polarity is minus) to find that the E 1/10 value was 82.1 lux.sec., and the ratio of sensitivity between both photoconductive layers was 1.1.

The thus obtained electrophotographic composite photosensitive material was electrified with −6.3 KV while undergoing the overall exposure, through a red filter, to the light from a 100 W halogen lamp, and successively subjected to corona discharge with +5.2 KV in the dark. Thereafter, the photosensitive material was measured in respect of the surface potential. The measured surface potential was +540 volt.

The photosensitive material, after having been electrified with +5.2 KV through the same procedure, was exposed imagewise, through an original comprising red, black and white patterns, to the light from a 100 W halogen lamp for 1 second, and then was developed with a positively charged red toner and a negatively charged black toner, whereby there were obtained red, black and white images corresponding to the red, black and white colors of the original.

The photosensitive material was subjected to the same procedure except that the corona discharge potential in the dark +5.2 KV was replaced by +4.8 KV, and then was measured in respect of the surface potential. The measured potential was −480 volt.

After the completion of corona discharge with +4.8 KV by repeating this procedure, the photosensitive material was image-wisely exposed for 1 second to the light from a 100 W halogen lamp using an original comprising blue, black and white patterns, and then was developed with a positively charged black toner and a negatively charged blue toner, whereby there were obtained the blue and black images corresponding to the blue and black patterns of the original.

EXAMPLE 17

An aluminum evaporation-coated polyester film was employed as a conductive substrate. Then, on this aluminum evaporation-coated surface was formed a first photoconductive layer in the following manner.

A dispersion was obtained by adding 20 parts of indigo and 10 parts of polycarbonate resin in 570 parts of methylene chloride and pulverizing the same for 5 hours in a ball mill. 150 parts of this dispersion was mixed with a solution obtained by dissolving 4 parts of 4-p-diethylaminophenyl-2,6-diphenylthiapyrylium perchlorate, 40 parts of 4,4-bis(diethylamino)-2,2'-dimethyltriphenylmethane and 50 parts of polycarbonate resin in 800 parts of methylene chloride and stirring. This mixture was stirred again and then was extensively applied onto the conductive substrate. The same was air-dried for 5 minutes, and then thermally dried for 10 minutes in an air bath heated to 80° C., whereby there was obtained a first photoconductive layer having a thickness of 30 μm. The electrophtographic sensitivity E 1/10 of said first photoconductive layer was measured under the same conditions as Example 15 wherein an element comprising the provision of a second photoconductive layer to be referred to hereinafter on a glass substrate was employed as a filter (however, the charged polarity is plus) to find that the E 1/10 value was 13.5 lux.sec.

Next, in order that 5 parts of photoconductive CdS and 5 parts of styrene-butadiene resin may be dispersed or dissolved in 100 parts of toluene, ultrasonic dispersion was carried out for 1 hour. The resulting coating liquid was extensively applied onto the first photoconductive layer to thereby form a charge generating layer having a thickness of about 4 μm.

Further, onto this layer was extensively applied a solution obtained by dissolving 5 parts of 2,5-bis(p-diethylaminophenyl)-1,3,4-oxadiazole and 5 parts of polyester resin in 90 parts of tetrahydrofuran and stirring. Then, the same was air-dried for 5 minutes and then thermally dried for 10 minutes in an air bath heated to 110° C., whereby there was formed a charge transfer layer having a thickness of about 20 μm to be made a second photoconductive layer. The E 1/10 value of the second photoconductive layer alone was measured under the exposure and electrification conditions for the first photoconductive layer (wherein, however, the filter was absent and the charged polarity was minus) with the result that the E 1/10 value was 23 lux.sec. and the ratio of sensitivity between both photoconductive layers was 1.8.

The thus obtained electrophotographic composite photosensitive material was electrified with −6.3 KV while undergoing the overall exposure, through a red filter, to the light from a 100 W halogen lamp, and successively subjected to corona discharge with +5.2 KV in the dark. Thereafter, the photosensitive material was measured in respect of the surface potential. It was +630 volt.

The photosensitive material was subjected to corona discharge with +5.2 KV through the same procedure, then was imagewisely exposed for 1 second to the light from a 100 W halogen lamp using an original comprising red and grey scale patterns, and then was developed with a positively charged red toner and a negatively charged black toner, whereby there were obtained red and black images corresponding to the red and grey scale patterns of the original.

EXAMPLE 18

A substrate was prepared by coating an aluminum plate with gold by evaporation to a thickness of 0.5 μm. Said substrate was evaporation-coated with $As_2Se_3$ alloy to a thickness of 55 μm while maintaining the substrate temperature at 230° C. to thereby obtain a first photoconductive layer. The electrophotographic sensitivity E 1/10 (quantity of exposure light required until the saturated surface potential is reduced to 1/10) of the first photoconductive layer in case where a second photoconductive layer referred to hereinafter coexisted with this first photoconductive layer at the time of exposure, in other words, an element comprising the provision of said second photoconductive layer on a glass substrate was employed as a filter was measured under the conditions: photosensitive surface intensity=20 lux, corona discharge=+6 KV. The thus measured E 1/10 was 7.8 lux.sec.

Ultrasonic dispersion was carried out in order to disperse or dissolve 5 parts of photoconductive CdS and 5 parts of polyester resin in 100 parts of tetrahydrofuran. The thus obtained coating liquid was applied extensively onto the first photoconductive layer to form a charge generating layer having a thickness of about 4 μm. Onto this layer, furthermore, was extensively applied a solution obtained by dissolving 5 parts of 2,5-bis(p-diethylaminophenyl)-1,3,4-oxadiazole and 5 parts of polyester resin in 90 parts of tetrahydrofuran. The same was air-dried for 5 minutes and then thermally dried for 10 minutes in an air bath heated to 110° C., whereby a charge transfer layer having a thickness of about 18 μm was formed to be a second photoconductive layer. The E 1/10 value of the second photoconductive layer alone was measured under the same exposure and electrification conditions for the first photoconductive layer (wherein, however, the filter is absent and the charged polarity is minus). Consequently, it was found that the thus measured E 1/10 was 10.8 and the ratio of sensitivity between both photoconductive layers was 1.4.

The thus obtained composite photosensitive material was subjected to corona discharge with −6.3 KV in the dark, and again corona discharge with +5.2 KV so that the surface potential may be reduced to substantially zero. Then, the thus treated photosensitive material was subjected to 1 second's imagewise exposure, through an original carrying red, blue, black and white patterns on the white area, to the light from a 100 W halogen lamp, and then was developed with a positively charged blue toner and a negatively charged red toner, whereby there were obtained distinct and high-contrast blue and red colored images corresponding to the blue and red area of the original, but the black and white areas of the original were reproduced as a white area freed from background stains.

Then, the photosensitive material, after the completion of the same electrification process, was exposed imagewise, using an original carrying a black-and-white negative pattern and through a blue filter, to the light from a 100 W halogen lamp for 1 second, and thereafter was developed with a positively charged black toner, whereby there was obtained a distinct and high-contrast reversal positive image freed from background stains.

When the same procedure as above-mentioned operation was repeated except that the blue filter was replaced by a red filter and the positively charged black toner was replaced by a negatively charged one, there was likewise obtained a distinct and high-contrast reversal positive image freed from background stains.

EXAMPLE 19

An amorphous selenium containing 6 parts of Te was applied onto an aluminum substrate by evaporation while maintaining the substrate temperature at 65° C. to obtain a 60 μm-thick first photoconductive layer. The electrophotographic sensitivity E 1/10 of this first photoconductive layer was measured under the same conditions as Example 18 where an element comprising the provision of a second photoconductive layer referred to hereinafter on a glass substrate was employed as a filter. The thus evaluated E 1/10 was 9.7 lux.sec.

3 parts of

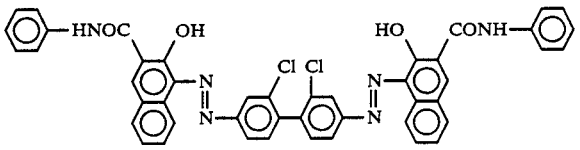

and 1 part of polyester resin were added to 96 parts of tetrahydrofuran and the same was pulverized and stirred for 5 hours in a ball mill. Then, it was extensively applied onto the first photoconductive layer, air-dried for 5 minutes and thereafter thermally dried for 15 minutes in an air bath heated to 50° C., thereby forming a charge generating layer having a thickness of about 0.8 μm. Onto this layer, furthermore, was extensively applied a solution obtained by dissolving 5 parts of

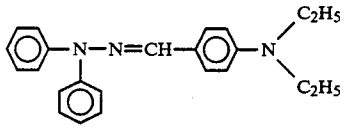

and 5 parts of polyester resin in 90 parts of tetrahydrofuran and stirring, air-dried for 5 minutes, and then thermally dried for 30 minutes in an air bath heated to 50° C., whereby a charge transfer layer having a thickness of about 14 μm was obtained to be a second photoconductive layer. The E 1/10 value of the second photoconductive layer alone was measured under the exposure and electrification conditions for the first photoconductive layer (wherein, however, the filter was absent and the charged polarity was minus) to find that E 1/10 was 7.3 lux.sec. and the ratio of sensitivity between both photoconductive layers was 1.3.

The thus obtained electrophotographic photosensitive material was electrified with −6.3 KV in the dark, and successively was subjected to corona discharge with +5.2 KV. Thereafter, the thus treated photosensitive material was measured to find that the surface potential was +620 volt.

The photosensitive material, after the completion of corona discharge with +5.2 KV through the same operation, was exposed imagewise, through an original comprising red, black and white patterns, to the light from a 100 W halogen lamp for 1 second, and then was developed with a positively charged red toner and a negatively charged black toner, whereby there were obtained red, black and white images corresponding to each of the red, black and white colors of the original.

And, the photosensitive material was subjected to the same operation as above-mentioned except that the corona discharge potential +5.2 KV was replaced by +4.8 KV. Thereafter, this material was measured in respect of the surface potential. The measured surface potential was −510 volt. This photosensitive material, after the repetition of this operation and the completion of corona discharge with +4.8 KV, was exposed imagewise, through an original comprising blue, black and white patterns, to the light from a 100 W halogen lamp for 1 second, and then was developed with a positively charged red toner and a negatively charged black toner, whereby there were obtained blue and black images corresponding to each of the blue and black colors of the original.

EXAMPLE 20

An amorphous selenium with a purity of 99.99% was applied onto an aluminum substrate by evaporation while maintaining the substrate temperature at 65° C. to thereby obtain a 50 μm-thick first photoconductive layer. The electrophotographic sensitivity E 1/10 of the first photoconductive layer was measured under the same conditions as Example 18 where an element comprising the provision of a second photoconductive layer referred to hereinafter on a glass substrate was employed as a filter. The thus evaluated E 1/10 was 67 lux.sec.

Next, onto the first photoconductive layer was extensively applied a solution obtained by adding 25 parts of β-type copper phthalocyanine, 10 parts of Permanent Red, 60 parts of poly-N-vinylcarbazole and 5 parts of polyester resin to 900 parts of tetrahydrofuran and subjecting the same to 5 hours' pulverization and stirring in a ball mill. The resulting solution was extensively applied onto the first photoconductive layer, air-dried, and then thermally dried for 30 minutes in an air bath heated to 50° C., thereby obtaining a second photoconductive layer having a thickness of about 16 μm. The E 1/10 value of the second photoconductive layer alone was measured under the exposure and electrification conditions for the first photoconductive layer (wherein, however, the filter was absent and the charged polarity was minus) to find that the measured E 1/10 was 54 lux.sec. and the ratio of sensitivity between both photoconductive layers was 1.2.

The thus obtained electrophotographic composite photosensitive material was electrified with −6.3 KV in the dark and successively subjected to corona discharge with +5.2 KV. Thereafter, this photosensitive material was measured in respect of the surface potential. The measured surface potential was +610 volt.

The photosensitive material was subjected to corona discharge with +5.2 KV through the same procedure, and thereafter was exposed imagewise, through an original comprising a grey scale pattern, to the light from a 100 W halogen lamp for 1 second. Then, the thus treated photosensitive material was developed with a positively charged red toner and a negatively charged black toner, whereby there were obtained red and black-and-white gradation reproduced images corresponding to each of the red and grey scale of the original.

EXAMPLE 21

Ultrasonic dispersion was effected for 1 hour in order that 5 parts of photoconductive CdS and 5 parts of polyester resin may be dispersed or dissolved in 100 parts of toluene. The resulting coating liquid was extensively applied onto the aluminum evaporation-coated surface of a conductive substrate comprising an aluminum evaporation-coated polyester film, thereby forming a charge generating layer having a thickness of about 4 μm.

Onto this layer was extensively applied a solution obtained by dissolving 5 parts of 2,5-bis(p-diethylaminophenyl)-1,3,4-oxadiazole and 5 parts of polyester resin in 90 parts of tetrahydrofuran and stirring. And the thus treated layer was air-dried for 5 minutes and then thermally dried for 10 minutes in an air bath heated to 110° C., whereby there was formed a charge transfer layer having a thickness of about 18 μm to be a first photoconductive layer. The electrophotographic sensitivity E 1/10 (quantity of exposure light required until the saturated surface potential is reduced 1/10) of the first photoconductive layer in case where a second photoconductive layer referred to hereinafter co-existed with this first photoconductive layer at the time of exposure, in other words, an element comprising the provision of said second photoconductive layer on a glass substrate was employed as a filter was measured under the conditions: photosensitive surface intensity=20 lux, corona discharge = −6 KV. The thus measured E 1/10 was 15.1 lux.sec. Furthermore, 2 parts of 4-p-diethylaminophenyl-2,6-diphenylthiapyrylium perchlorate, 40 parts of 4,4'-bis(diethylamino)-2,2'-dimethyltriphenyl methane and 58 parts of polycarbonate resin were dissolved in 800 parts of methylene chloride and stirred. The resulting solution was applied extensively onto the first photoconductive layer, air-dried for 5 minutes and then thermally dried for 10 minutes in an air bath heated to 80° C. to thereby obtain a 20 μm-thick second photoconductive layer. The E 1/10 value of the second photoconductive layer alone was measured under the exposure and electrification conditions for the first photoconductive layer (wherein, however, the filter was absent and the charged polarity was plus) to find that the measured E 1/10 was 14.3 lux.sec. and the ratio of sensitivity between both photoconductive layers was 1.1.

The thus obtained composite photosensitive material was electrified with −6.3 KV while undergoing the overall radiation, through a red filter, of the light from a 100 W halogen lamp, and was successively subjected to corona discharge with +5.2 KV in the dark. The measured surface potential of the thus electrified photosensitive material was +570 volt. The photosensitive material was subjected to corona discharge with +5.2 KV following the same procedure, and thereafter was exposed image-wise, through an original comprising red, black and white patterns, to the light from a 100 W halogen lamp for 1 second. Then, the thus treated photosensitive material was developed with a positively charged red toner and a negatively charged black toner, whereby there were obtained red and black images corresponding to each of the red and black colors of the original.

And, the photosensitive material was subjected to the same operation as above-mentioned except that the corona discharge potential in the dark +5.2 KV was replaced by +4.8. Thereafter, this photosensitive material was measured in respect of the surface potential. This measured value was −450 volt.

This photosensitive material, after the repetition of this operation and the completion of corona discharge with +4.8 KV, was exposed imagewise, through an original comprising blue, black and white patterns, to the light from a 100 W halogen lamp for 1 second, and then was developed with a negative charged blue toner and a positively charged black toner, whereby there were obtained blue and black images corresponding to each of the blue and black colors of the original.

EXAMPLE 22

3 parts of β-copper phthalocyanine and 1 part of polyester resin were added to 96 parts of tetrahydrofuran, and the same was subjected to 5 hours' pulverization and stirring in a ball mill. Thereafter, this was extensively applied onto the aluminum evaporation-coated surface of a conductive substrate comprising an aluminum evaporation-coated polyester film, air-dried for 5 minutes and then thermally dried in an air bath heated to 90° C., thereby forming a charge generating layer having a thickness of about 0.5 μm.

Onto this layer, furthermore, was extensively applied a solution obtained by dissolving 5 parts of polyvinylcarbazole and 5 parts of

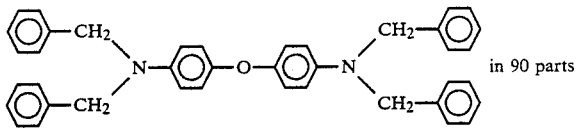

of tetrahydrofuran and stirring. The same was air-dried for 5 minutes, and then subjected to 10 minutes' thermal drying in an air bath heated to 90° C., whereby there was formed a charge transfer layer having a thickness of about 16 μm to be a first photoconductive layer. The electrophotographic sensitivity E 1/10 of this first photoconductive layer was measured under the same conditions as Example 21 wherein an element comprising the provision of said second photoconductive layer on a glass substrate was employed as a filter. The evaluated E 1/10 was 81 lux.sec.

Further, a solution obtained by dissolving 54 parts of poly-N-vinylcarbazole, 40 parts of 2,4,7-trinitrofluorenone and 6 parts of polyester resin were added to 90 parts of tetrahydrofuran and stirring was applied extensively onto the first photoconductive layer. And, the same was air-dried for 5 minutes and then subjected to 10 minutes' thermal drying in an air bath heated to 90° C., thereby obtaining a second photoconductive layer having a thickness of about 17 μm. The E 1/10 value of this second photoconductive layer alone was measured under the exposure and electrification conditions for said first photoconductive (wherein, however, the filter was absent and the charged polarity was plus). The obtained E 1/10 was 45 lux.sec. and the ratio of sensitivity between both photoconductive layers was 1.8.

The thus obtained composite photosensitive material was subjected to corona discharge with +6.3 KV while undergoing the overall exposure to a blue light, and successively corona discharge with −5.2 KV in the dark for reducing the surface potential to about zero. Then, the thus treated photosensitive material was subjected to 1 second's imagewise exposure, through an original carrying red, blue, black and white patterns on the white area, to the light from a 100 W halogen lamp, and then was developed with a positively charged blue toner and a negatively charged red toner, whereby there were obtained distinct and high-contrast blue and red images corresponding to the blue area and the red area of the original, but the black and white areas of the original were reproduced as a white area freed from background stains.

And, the photosensitive material, after having been electrified by means of the same process as above-mentioned, was subjected to 1 second's imagewise exposure, using an original carrying a black-and-white negative pattern and through a blue filter, to the light from a 100 W halogen lamp, and then was developed with a positively charged black toner, thereby obtaining a distinct and high-contrast reversal positive image freed from background stains.

EXAMPLE 23

Ultrasonic dispersion was carried out for 1 hour so that 5 parts of photoconductive CdS and 5 parts of styrene-butadiene resin may be dispersed or dissolved in 100 parts of toluene, and the resulting coating liquid was applied extensively onto the aluminum evaporation-coated surface of a conductive substrate comprising an aluminum evaporation-coated polyester film to thereby form a charge generating layer having a thickness of about 4 μm.

Onto this layer, furthermore, was extensively applied a solution obtained by dissolving 5 parts of 2,5-bis(p-diethylaminophenyl)-1,3,4-oxadiazole and 5 parts of polyester resin in 90 parts of tetrahydrofuran and stirring. The same was air-dried for 5 minutes, and then thermally dried for 10 minutes in an air bath heated to 110° C., whereby a charge transfer layer having a thickness of about 20 μm was formed to be a first photoconductive layer. The electrophotographic sensitivity E 1/10 of this first photoconductive layer was measured under the same conditions as Example 21 wherein an element comprising the provision of a second photoconductive layer referred to hereinafter on a glass substrate was employed as a filter. The thus measured E 1/10 was 14.0 lux.sec.

Next, 20 parts of indigo and 10 parts of polycarbonate resin were added to 570 parts of methylene chloride, and the same was pulverized for 25 hours in a ball mill. 150 parts of the resulting dispersion was mixed with a solution obtained by dissolving 4 parts of 4-p-diethylaminophenyl-2,6-diphenylthiapyrylium perchlorate, 40 parts of 4,4'-bis(diethylamino)-2,2'-dimethyltriphenyl methane and 57 parts of polycarbonate resin in 800 parts of methylene chloride and stirring. This mixed solution was stirred again and then extensively applied onto the first photoconductive layer. The thus treated layer was air-dried for 5 minutes, and then thermally dried for 10 minutes in an air bath heated to 80° C., thereby obtaining a second photoconductive layer having a thickness of 30 μm. The E 1/10 value of said second photoconductive layer alone was measured under the exposure and electrification conditions for the first photoconductive layer (wherein, however, the filter was absent and the charged polarity was plus). The measured E 1/10 was 13.7 lux.sec., and the ratio of sensitivity between both photoconductive layers was 1.02.

The thus obtained composite photosensitive material was electrified with −6.3 KV while undergoing the overall radiation, through a red filter, to the light from a 100 W halogen lamp, and successively subjected to corona discharge with +5.2 KV in the dark. Thereafter, the surface potential measured thereof was +570 volt.

The photosensitive material, after having been subjected to corona discharge with +5.2 KV through the same operation, was exposed imagewise, through an original comprising red and grey scale patterns, to the light from a 100 W halogen lamp for 1 second, and thereafter was developed with a positively charged red toner and a negatively charged black toner to thereby obtain red and black-and white gradation reproduced images corresponding to each of the red and grey scale of the original.

What is claimed is:

1. A dichromatic electrophotography process, which comprises: providing a composite photosensitive material comprising an electrically conductive substrate layer made of a metal selected from the group consisting of Au, Pt and Pd, a first photoconductive layer made of $As_2Se_3$ laminated on said electrically conductive substrate layer, said first photoconductive layer being capable of absorbing and being rendered photoconductive by visible radiation having a first wavelength range, said first photoconductive layer possessing the properties that it can be charged only in one polarity in relation to said substrate and permits light decay, a second photoconductive layer laminated on said first photoconductive layer, said second photoconductive layer being capable of transmitting visible radiation of said first wavelength range and being capable of absorbing and being rendered photoconductive by visible radiation of a second wavelength range which is different from said first wavelength range, the sensitivity ratio of said second photoconductive layer to said first photoconductive layer being in the range of from 1 to 20 when said second photoconductive layer is irradiated with white light so that the sensitivity of said second photoconductive layer is its sensitivity to white light and the sensitivity of said first photoconductive layer is its sensitivity to white light minus the second wavelength range, said first and second photoconductive layers being capable of holding electric charges of opposite polarities with respect to each other and each being capable of accepting and also retaining surface potentials sufficient to develop an electrostatic latent image with toner; applying a first electrostatic charge of a polarity opposite to said one polarity to the second layer in the dark to form a charge of the opposite polarity on said second layer and to cause a second charge of said one polarity to be injected from said electrically conductive substrate layer into said first layer; then applying a second electrostatic charge of said one polarity to the second layer wherein the second electrostatic charge is of lower magnitude than said first electrostatic charge; and then radiating a light image onto said second layer capable of rendering photoconductive a partial region of a single one of said first photoconductive layer and said second photoconductive layer while leaving another partial region of said single photoconductive layer nonconductive whereby to form an electrostatic latent image in which the nonconductive region has a different polarity than the conductive region of said single photoconductive layer; and then developing said electrostatic latent image with two differently colored toners of opposite polarities.

* * * * *

UNITED STATES PATENT AND TRADEMARK OFFICE

CERTIFICATE OF CORRECTION

PATENT NO. : 4,521,504

DATED : June 4, 1985

INVENTOR(S) : Seiiti Sakuma et al

It is certified that error appears in the above-identified patent and that said Letters Patent is hereby corrected as shown below:

On the title page, item [75]; change the name of the first inventor from "Seiitj Sakuma" to ---Seiiti Sakuma---.

Signed and Sealed this

*Thirty-first* Day of *December 1985*

[SEAL]

*Attest:*

DONALD J. QUIGG

*Attesting Officer*

*Commissioner of Patents and Trademarks*